US009105962B2

(12) United States Patent
Chang

(10) Patent No.: US 9,105,962 B2
(45) Date of Patent: Aug. 11, 2015

(54) ANTENNA MOUNT AND ITS PROTECTIVE MODULE

(71) Applicant: ACCTON TECHNOLOGY CORPORATION, Hsinchu (TW)

(72) Inventor: Hsien-Te Chang, Taoyuan County (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 90 days.

(21) Appl. No.: 13/950,421

(22) Filed: Jul. 25, 2013

(65) Prior Publication Data

US 2014/0087596 A1 Mar. 27, 2014

(30) Foreign Application Priority Data

Sep. 27, 2012 (TW) ..... 101218730 U

(51) Int. Cl.

| | |
|---|---|
| ***H01R 9/05*** | (2006.01) |
| ***H01Q 1/12*** | (2006.01) |
| ***H01R 24/46*** | (2011.01) |
| *H01R 103/00* | (2006.01) |
| *H01R 13/66* | (2006.01) |

(52) U.S. Cl.

CPC ..... *H01Q 1/12* (2013.01); *H01R 24/46* (2013.01); *H01R 13/6616* (2013.01); *H01R 2103/00* (2013.01); *H01R 2201/02* (2013.01)

(58) Field of Classification Search

CPC ..... H01R 9/0521; H01R 2103/00; H01R 13/7032; H01R 24/46

USPC ..... 439/583, 188, 718, 944

See application file for complete search history.

(56) References Cited

U.S. PATENT DOCUMENTS

| | | | | | |
|---|---|---|---|---|---|
| 3,873,785 | A * | 3/1975 | Lieberman | ..... | 200/51.1 |
| 4,971,569 | A * | 11/1990 | Gooch et al. | ..... | 439/188 |
| 5,601,441 | A * | 2/1997 | Weinstein et al. | ..... | 439/188 |
| 5,702,262 | A * | 12/1997 | Brown et al. | ..... | 439/188 |
| 5,882,217 | A * | 3/1999 | Aponte et al. | ..... | 439/188 |
| 6,227,889 | B1 * | 5/2001 | Wu | ..... | 439/188 |
| 8,172,617 | B2 * | 5/2012 | Peng | ..... | 439/620.03 |

* cited by examiner

*Primary Examiner* — Hae Hyeon

(74) *Attorney, Agent, or Firm* — Ming Chow; Sinorica, LLC

(57) ABSTRACT

An antenna mount includes a main member, a first contacting member, a second contacting member, and a driving member. The main member has a chamber therein to receive the first contacting member, the second contacting member and the driving member. The first contacting member electrically connects to a signal wire of a cable for signal transmission, and the main member electrically connects to a ground wire of the cable. Two ends of the second contacting member are respectively connected to the main member and contacted with the first contacting member, wherein the second contacting member has a predetermined resistance. Once a connector of an antenna is engaged, the driving member is moved to separate the second contacting member and the first contacting member; and when the connector of the antenna is disengaged, the second contacting member contacts with the first contacting member again as a protective circuit.

10 Claims, 4 Drawing Sheets

ANTENNA MOUNT AND ITS PROTECTIVE MODULE

The current application claims a foreign priority to the patent application of Taiwan No. 101218730 filed on Sep. 27, 2012.

BACKGROUND OF THE INVENTION

1. Field of the Invention

The present invention relates generally to an antenna, and more particularly to an antenna mount and its protective module.

2. Description of the Related Art

Since wireless telecommunication technology continually advanced, there are a lot of electronic devices transmit and receive wireless signals through antennas. Such antennas are usually detachably connected to the electronic devices, so that they can be disengaged easily for the purpose of repair or maintenance. Therefore, the electronic devices are usually provided with an antenna mount (N-type female connector is the most common type) to engage an antenna (with an N-type male connector as an example). Besides, the antennas may also be disengaged the electronic devices for carrying and packaging purposes.

As the wireless telecommunication technology is getting popular, service range of wireless signal transmission is demanded to be wider. For satisfying the service range's needs, the electronic devices have to provide stronger signals by raising the output power of the antennas. However, if the antenna is disengaged while the electronic device is generating signals, high power signals may reflect back to the output source of the power amplifier inside the electronic device and cause damage to the power amplifier.

SUMMARY OF THE INVENTION

The primary objective of the present invention is to provide an antenna mount and its protective module, which establishes a protective circuit while the antenna is disengaged. In the other hand, the protective circuit can also be disconnected, and the signal transmission function of the antenna can work normally while the antenna is engaged.

According to the objective of the present invention, the present invention provides an antenna mount, which is used to connect a cable and a connector of an antenna. The connector of the antenna has a signal conductor, and the cable has a signal wire and a ground wire. The antenna mount comprises a main member, a first contacting member, a second contacting member, and a driving member. The main member is conductive, and is electrically connected to the ground wire of the cable, wherein the main member has a chamber therein. The first contacting member is conductive, and is received in the chamber of the main member, wherein the first contacting member is insulated from the chamber. The first contacting member is electrically connected to the signal wire of the cable, and the first contacting member contacts the signal conductor of the connector while the connector is engaged to the antenna mount. The second contacting member is conductive, flexible and having a predetermined resistance. One end of the second contacting member is fixated on the main member, and the other end of the second contacting member is contacted to the first contacting member. The driving member is made of an insulating material, and is received in the chamber of the main member. The driving member can be moved between a first position and a second position back and forth, wherein the driving member pushes the second contacting member to be separated from the first contacting member as the driving member is located in the second position.

In an embodiment, the present invention further provides a protective module of an antenna mount. The antenna mount comprises a main member with a chamber, and a first contacting member received in the chamber of the main member, wherein the main member and the first contacting member are both conductive, and the first contacting member is insulated from the main member. The protective module comprises a plug member, a second contacting member, and a driving member. The plug member is made of an insulating material, and is received in the chamber of the main member. The plug member has a perforation and a guiding hole, wherein the perforation allows the first contacting member to pass through, and the guiding hole interconnects with the perforation. The second contacting member is flexible, conductive, and has a predetermined resistance. The second contacting member is received in the guiding hole. One end of the second contacting member is fixated on the main member, and the other end of the second contacting member is contacted to the first contacting member. The driving member is made of an insulating material, and received in the guiding hole of the plug member, and the driving member can be moved between a first position and a second position, wherein the driving member pushes the second contacting member to be separated from the first contacting member as the driving member is located in the second location.

With design of the present invention, when the antenna is disengaged, the protective module establishes a protective circuit to avoid the high power signals from being reflected back into the output source of the power amplifier inside the electronic device and causing damage, and the protective circuit is disconnected automatically as the antenna is engaged for transmitting signals.

DETAILED DESCRIPTION OF THE INVENTION

The detailed description and technical contents of the present invention will be explained with reference to the accompanying drawings. However, the drawings are illustrative only but not used to limit the present invention.

Figure 1:
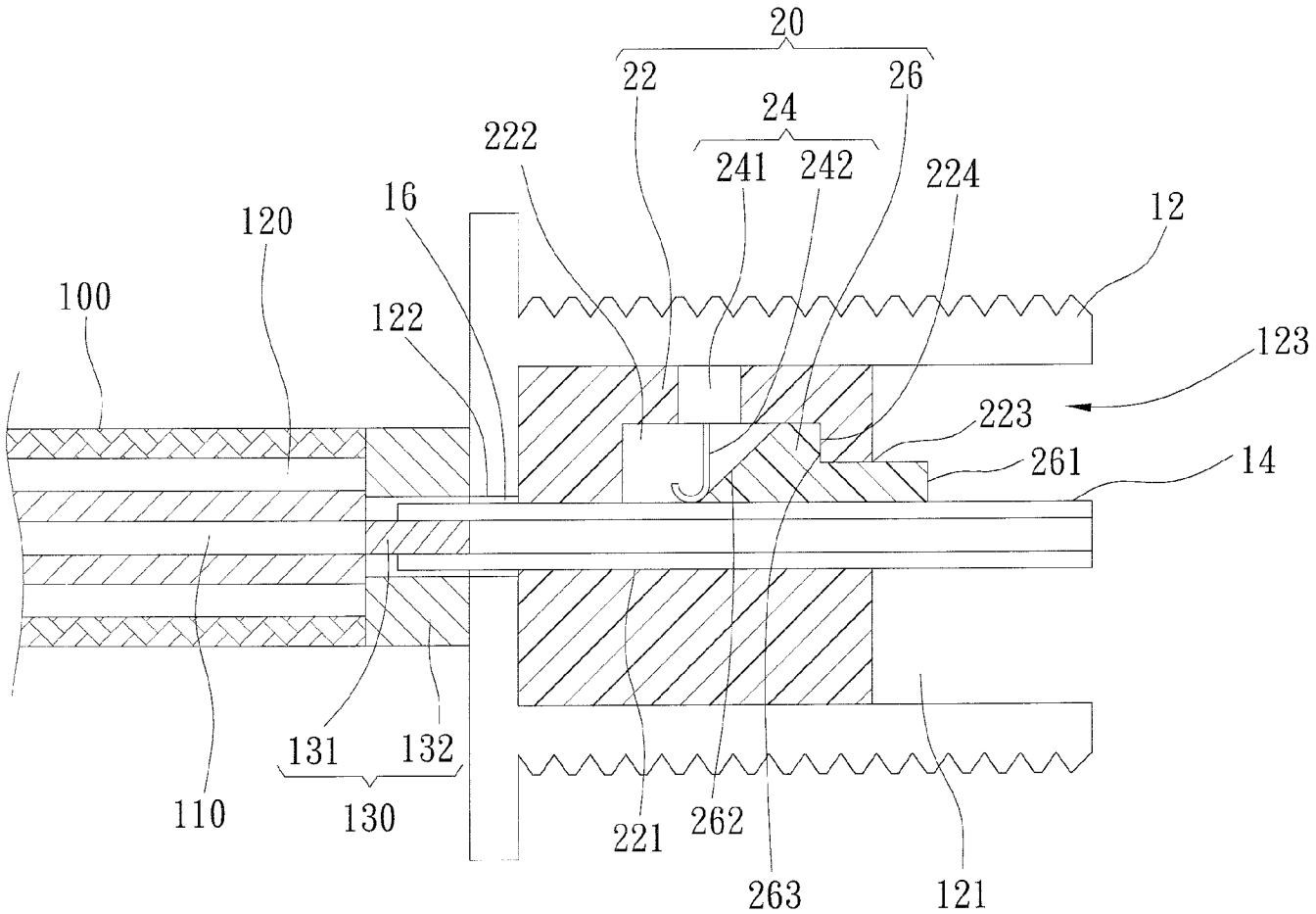
FIG. 1 is a sectional view of a preferred embodiment of the present invention.

FIG. 1 shows an antenna mount of the preferred embodiment of the present invention, which is used to engage a male connector 130 of a RF (radio frequency) cable 100. The male connector 130 has an inner conductor 131 and an outer conductor 132. The inner conductor 131 is electrically connected to a signal wire 110 of the RF cable 100, and the outer conductor 132 is electrically connected to a ground wire 120 of the RF cable 100.

The antenna mount includes a main member 12, a first contacting member 14 and a protective module 20. The main member 12 is made of a conductive material, and has a chamber 121 therein. The main member 12 has a bore 122 and an opening 123 at opposite sides, and each of the bore 122 and the opening 123 is interconnected with the chamber 121 respectively. In an embodiment, the main member 12 is a barrel-like member made of copper, and it could also be made of iron, aluminum, silver, or other conductive materials in other embodiments. The main member 12 is used to contact the outer conductor 132 of the male connector 130, and the main member 12 electrically connects to the ground wire 120 of the RF cable 100 for grounding purpose.

The first contacting member 14 is made of a conductive material, and is received in the chamber 121 of the main member 12. One end of the first contacting member 14 extends out of the main member 12 through the bore 122. In an embodiment, the first contacting member 14 is a pin-like member made of copper, and it could be made of iron, aluminum, silver, or other conductive materials in other embodiments. The first contacting member 14 is used to contact the inner conductor 131 of the male connector 130, and therefore to electrically connect to the signal wire 110 of the RF cable 100 for signal transmission purpose. Short-circuited between the first contacting member 14 and the main member 12 may affect signal transmission, and in order to prevent such problem, an insulator 16 is provided in the bore 122 to insulate the first contacting member 14 from the main member 12.

The protective module 20 has a plug member 22, a second contacting member 24 and a driving member 26. The plug member 22 is made of an insulating material, such as plastic, and is received in the chamber 121 of the main member 12. The plug member 22 has a perforation 221 and a guiding hole 222 which is interconnected with the perforation 221, and the perforation 221 allows the first contacting member 14 to pass through. The plug member 22 further has a gap 223 at a side facing the opening 123 of the main member 12, and the gap 223 is interconnected with the guiding hole 222. The plug member 22 has a first surface 224 on a sidewall of the guiding hole 222, and the first surface 224 is adjacent to an inner end of the gap 223.

The second contacting member 24 is conductive and flexible, which is received in the guiding hole 222 of the plug member 22, and the second contacting member 24 has a predetermined resistance. The second contacting member 24 has two ends, one end is fixated onto the main member 12, and the other end contacts the first contacting member 14. While the male connector 130 is disengaged, the signals transmitted by the signal wire 110 of the RF cable 100 are guided by the first contacting member 14 to go into the second contacting member 24, and since the second contacting member 24 has the predetermined resistance, the signals could not be reflected back to the signal source, but sent onto the main member 12, and finally transmitted to the ground wire 120 to establish a protective circuit, which may be able to prevent the electronic device from being damaged. As mentioned above, the second contacting member 24 is flexible, and the second contacting member 24 can be bent and separated from the first contacting member 14, and by doing so, the protective circuit is disconnected. In an embodiment, the second contacting member 24 includes a resistor 241 and a metal elastic piece 242, wherein the resistor 241 is a chip resistor with a predetermined resistance, and is attached to a sidewall of the chamber 121 of the main member 12. In an embodiment, the resistance of the resistor 241 is 50 ohms, which is an impedance matching of a standard wireless circuit, but the resistance of the resistor 241 is not always 50 ohms, it could be a different value according to other design standards in other embodiments. The metal elastic piece 242 is flexible, and shaped as a round-hook. One side of the metal elastic piece 242 connects to the resistor 241, while the other side is suspended to contact the first contacting member 14 under normal condition.

Figure 2:
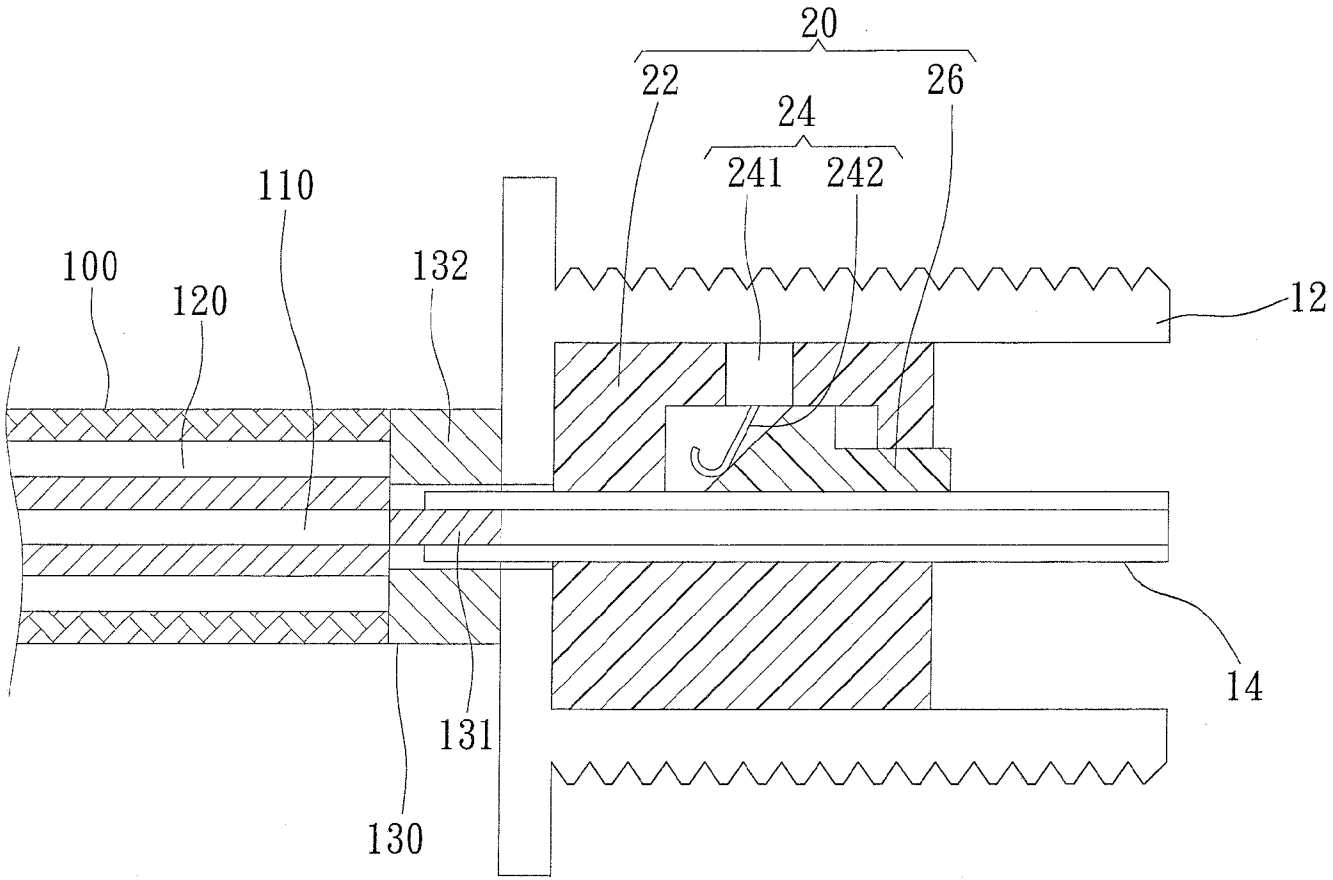
FIG. 2 is a sectional view of the preferred embodiment of the present invention, showing the contacting member at the second position.

The driving member 26 is made of an insulating material, such as plastic, and is received in the guiding hole 222 of the plug member 22. The driving member 26 can be moved between a first position (as FIG. 1) and a second position (as FIG. 2) back and forth, wherein the first position is closer to the gap 223 than the second position. The driving member 26 has a first end 261 and a second end 262 at opposite sides, and in an embodiment, the first end 261 extends out of the plug member 22 through the gap 223. The second end 262 of the driving member 26 is an inclined plane. While the driving member 26 moves from the first position to the second position, the inclined plane bends the metal elastic piece 242 to separate the metal elastic piece 242 and the first contacting member 14. Therefore, the first contacting member 14 and the second contacting member 24 are disconnected. The driving member 26 has a second surface 263 between the first end 261 and the second end 262. The second surface 263 is associated with the first surface 224 of the plug member 22, and the second surface 263 keeps the driving member 26 remain inside the plug member 22 by stopping the first surface 224 when the driving member 26 is located in the first position.

Figure 3:
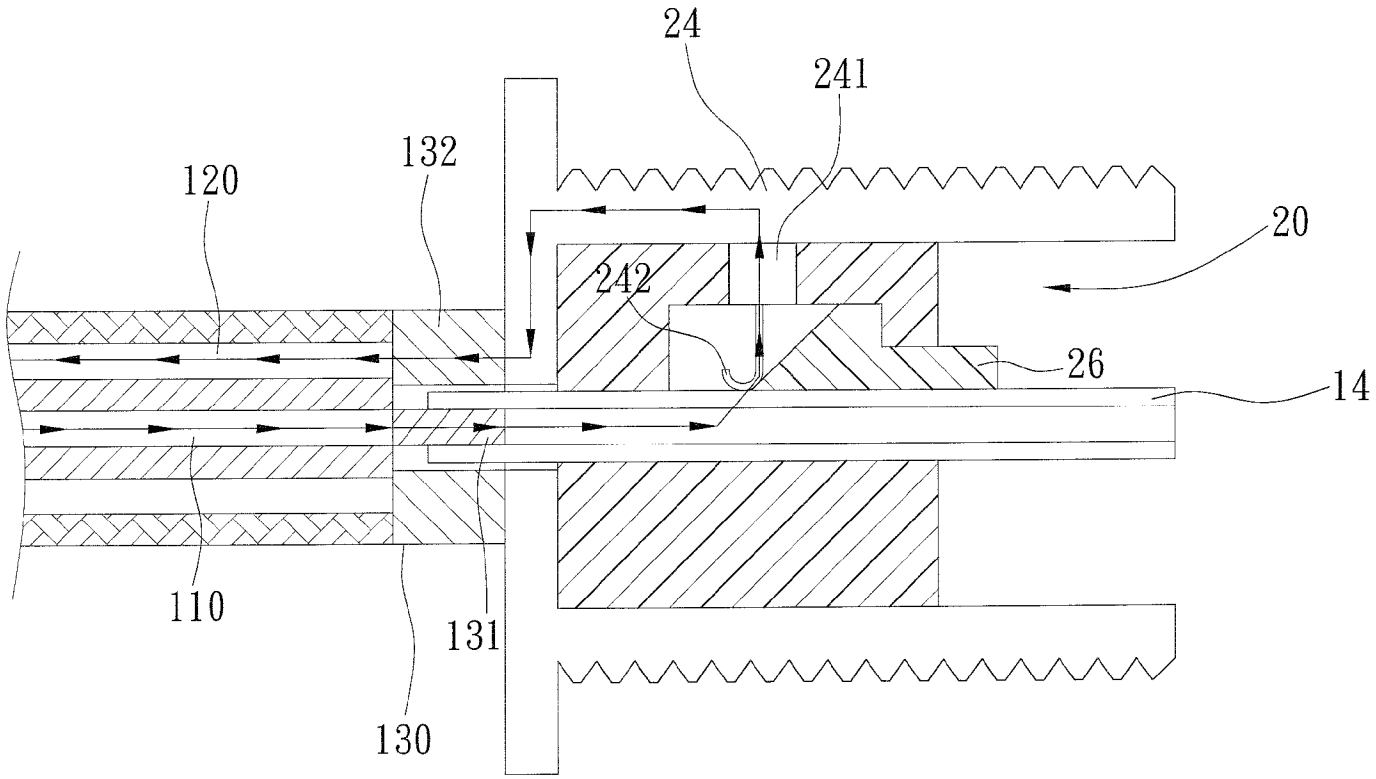
FIG. 3 is a sectional view of the preferred embodiment of the present invention, showing the signal flow when the antenna receives the signal.

As shown in FIG. 3, the driving member 26 locates in the first position when the antenna mount is disengaged an antenna, and the metal elastic piece 242 of the second contacting member 24 contacts with the first contacting member 14. Signals from the signal wire 110 are guided by the first contacting member 14 to go into the second contacting member 24, and then the main member 12, and finally the ground wire 120, which works as a protective circuit to prevent the electronic device from being damaged by the high power signals.

Figure 4:
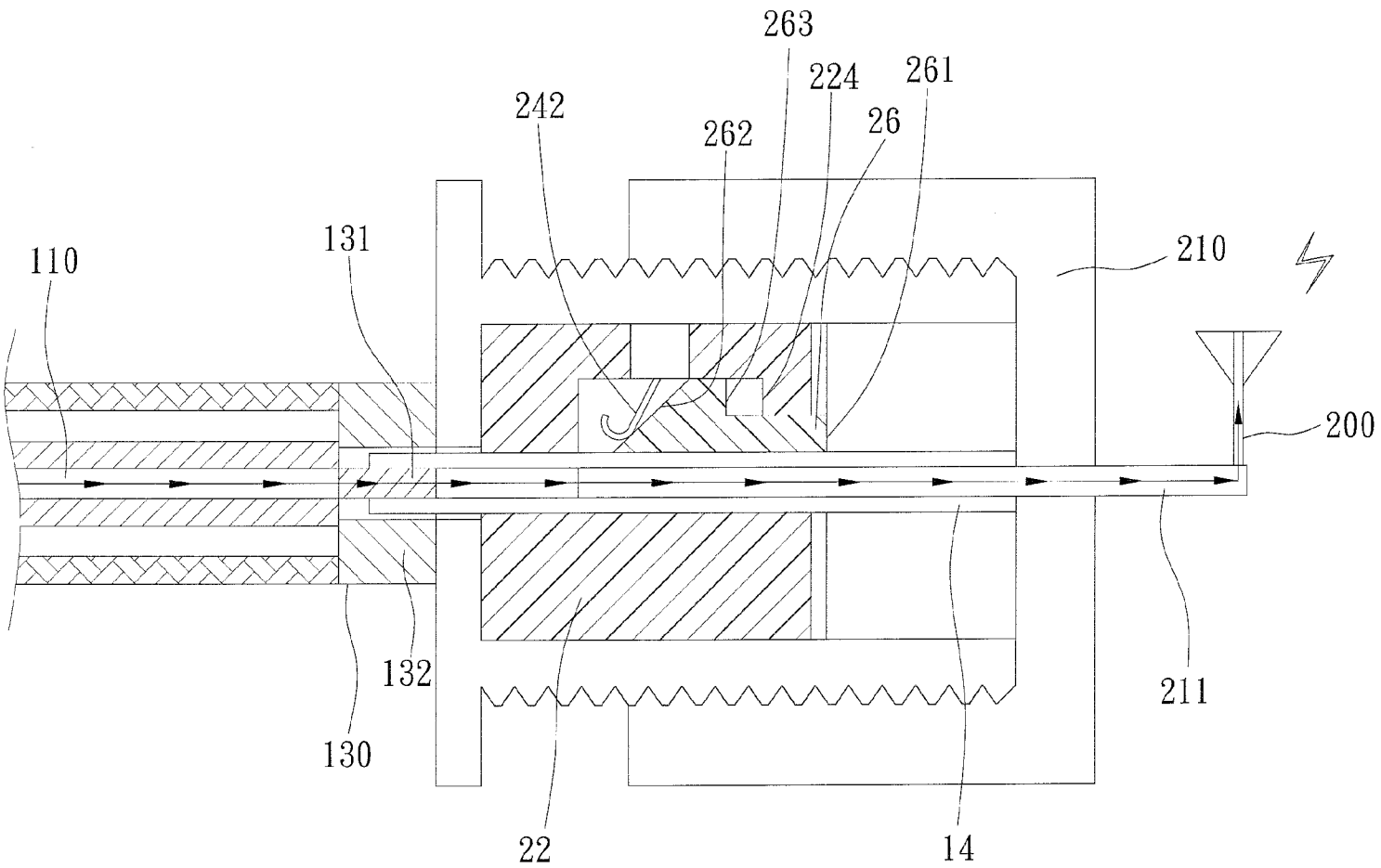
FIG. 4 is a sectional view of the preferred embodiment of the present invention, showing the signal flow when the antenna is engaged.

As shown in FIG. 4, when a male connector 210 of an antenna 200 engages the antenna mount, a signal conductor 211 of the male connector 210 contacts the first contacting member 14, and the driving member 26 is pushed by the male connector 210 to the second position from the first position. At the moment, the second surface 263 of the driving member 26 leaves the first surface 224 of the plug member 22, and the inclined plane of the driving member 26 bends the suspended end of the metal elastic piece 242 to make the second contacting member 24 leave the first contacting member 14. As a result, the protective circuit is automatically disconnected.

Therefore, the signals from the signal wire 110 of the cable 100 are transmitted to the male connector 210 through the first contacting member 14, and then transmitted out through the antenna 200.

While the metal elastic piece 242 is bent, the metal elastic piece 242 pushes the driving member 26 towards the first position, and the driving member 26 will return to the first position when the male connector 210 is disengaged. And once the driving member 26 is located at the first position, the metal elastic piece 242 contacts the first contacting member 14 again to form the protective circuit.

The description above is a few preferred embodiments of the present invention, and the equivalence of the present invention is still in the scope of claim construction of the present invention.

What is claimed is:

1. An antenna mount, connecting to a cable and a connector of an antenna, the connector of the antenna having a signal conductor, and the cable having a signal wire and a ground wire, the antenna mount comprising:

a main member, being conductive and electrically connected to the ground wire of the cable, and the main member having a chamber therein;

a first contacting member, being conductive and received in the chamber of the main member, the first contacting member being insulated from the chamber and electrically connected to the signal wire of the cable, wherein the first contacting member contacts the signal conductor of the connector while the connector is engaged to the antenna mount;

a second contacting member, being conductive, flexible and having a predetermined resistance, wherein one end of the second contacting member is fixated on the main member and the other end of the second contacting member is contacted to the first contacting member;

a driving member, being made of an insulating material and received in the chamber, the driving member can be moved between a first position and a second position back and forth, wherein the driving member pushes the second contacting member to be separated from the first contacting member as the driving member is located in the second position;

a plug member, being made of an insulating material and received in the chamber of the main member, having a perforation for the first contacting member passing through accordingly; and a guiding hole being interconnected with the perforation and receiving the second contacting member and the driving member therein.

2. The antenna mount as claimed in claim 1, wherein a gap is formed on one side of the plug member and interconnected with the guiding hole, the driving member comprising a first end and a second end, wherein the first end is assembled through the gap as the driving member located in the first position, and the second end pushes the second contacting member as the driving member located in the second position.

3. The antenna mount as claimed in claim 2, wherein the second end of the driving member is an inclined plane for pushing the second contacting member.

4. The antenna mount as claimed in claim 1, wherein the plug member has a first surface, and the driving member has a second surface direct to the first surface, wherein the first surface is contacted with the second surface as the driving member located in the first position, and the first surface and the second surface are separated as the driving member located in the second position.

5. The antenna mount as claimed in claim 1, wherein the second contacting member comprises:

a metal elastic piece contacting to the first contacting member; and a resistor with a predetermined resistance, connected to the metal elastic piece and fixated onto the main member.

6. A protective module for an antenna mount, the antenna mount comprising a main member with a chamber and a first contacting member which being received in the chamber of the main member, the main member and the first contacting member both being conductive, and the first contacting member being insulated from the main member, the protective module comprising:

a plug member, being made of an insulating material and received in the chamber of the main member, the plug member having a perforation and a guiding hole, wherein the perforation allows the first contacting member to pass through, and the guiding hole is interconnected with the perforation;

a second contacting member, being flexible, conductive and having a predetermined resistance, the second contacting member being received in the guiding hole, and one end of the second contacting member is fixated on the main member and the other end of the second contacting member is contacted to the first contacting member; and a driving member, being made of an insulating material, and received in the guiding hole of the plug member, the driving member can be moved between a first position and a second position, wherein the driving member pushes the second contacting member to be separated from the first contacting member as the driving member is located in the second position.

7. The protective module as claimed in claim 6, wherein a gap is formed on one side of the plug member and interconnected with the guiding hole, the driving member comprising a first end and a second end, wherein the first end is assembled through the gap as the driving member located in the first position, and the second end pushes the second contacting member as the driving member located in the second position.

8. The protective module as claimed in claim 7, wherein the second end of the driving member is an inclined plane for pushing the second contacting member.

9. The protective module as claimed in claim 6, wherein the plug member has a first surface, and the driving member has a second surface direct to the first surface, wherein the first surface is contact with the second surface as the driving member located in the first position, and the first surface and the second surface are separated as the driving member located in the second position.

10. The protective module as claimed in claim 6, wherein the second contacting member comprises:

a metal elastic piece contacting to the first contacting member; and a resistor with a predetermined resistance, connected to the metal elastic piece and fixated onto the main member.

* * * * *